US007619372B2

(12) United States Patent
Garrity

(10) Patent No.: US 7,619,372 B2
(45) Date of Patent: Nov. 17, 2009

(54) METHOD AND APPARATUS FOR DRIVING A LIGHT EMITTING DIODE

(75) Inventor: Paul J. Garrity, Rockwall, TX (US)

(73) Assignee: Lighting Science Group Corporation, Dallas, TX (US)

( * ) Notice: Subject to any disclaimer, the term of this patent is extended or adjusted under 35 U.S.C. 154(b) by 278 days.

(21) Appl. No.: 11/713,558

(22) Filed: Mar. 2, 2007

(65) Prior Publication Data

US 2008/0211419 A1 Sep. 4, 2008

(51) Int. Cl.
*H05B 37/00* (2006.01)

(52) U.S. Cl. ..... 315/291; 315/224; 315/276

(58) Field of Classification Search ..... 315/149, 315/224, 276, 291
See application file for complete search history.

(56) References Cited

U.S. PATENT DOCUMENTS 5,233,270 A 8/1993 Nilssen
6,013,985 A * 1/2000 Green et al. ..... 315/149

FOREIGN PATENT DOCUMENTS

DE 197 29 690 A1 1/1999
WO WO 2006 / 038157 A2 4/2006

OTHER PUBLICATIONS

PCT Search Report (PCT/ISA/220 and 210) and Written Opinion (PCT/ISA/237) dated Jul. 22, 2008 for PCT Application No. PCT/US2008/055474, 13 pages.

* cited by examiner

*Primary Examiner*—David Hung Vu
(74) *Attorney, Agent, or Firm*—Cantor Colburn LLP

(57) ABSTRACT

An apparatus includes circuitry that responds to application to its input of an alternating current input signal by producing at its output an output signal suitable for driving an electronic light generating element. The circuitry includes a regulating section that has a magnetic switch and that causes a current flowing through the output to be maintained substantially at a selected value. A different aspect relates to a method for operating circuitry having an input, an output and a magnetic switch. The method includes causing the circuitry to respond to application to its input of an alternating current input signal by producing at its output an output signal suitable for driving an electronic light generating element, where the magnetic switch is used in regulating a current flowing through the output so as to maintain the current substantially at a selected value.

20 Claims, 3 Drawing Sheets

METHOD AND APPARATUS FOR DRIVING A LIGHT EMITTING DIODE

FIELD OF THE INVENTION

This invention relates in general to devices that emit electromagnetic radiation and, more particularly, to devices that use light emitting diodes or other semiconductor parts to produce electromagnetic radiation.

BACKGROUND

Over the past century, a variety of different types of lightbulbs have been developed, including incandescent lightbulbs and fluorescent lights. The incandescent bulb is currently the most common type of bulb. In an incandescent bulb, electric current is passed through a metal filament disposed in a vacuum, causing the filament to glow and emit light.

Recently, bulbs have been developed that produce illumination in a different manner, in particular through the use of light emitting diodes (LEDs). An LED lightbulb typically includes a power supply circuit that drives the LEDs. The power supply circuit is typically configured to regulate the amount of current flowing through the LEDs, to keep it substantially uniform over time, so that the level of illumination produced by the LEDs remains substantially uniform over time. Various techniques have previously been used to achieve this current regulation. While these existing regulation techniques have been generally adequate for their intended purposes, they have not been entirely satisfactory in all respects.

As one aspect of this, pre-existing current regulation circuits often have the effect of producing a phase difference between the voltage and current, which in turn means the power supply circuit needs to make a power correction. This phase difference can occur, for example, where a large capacitance is used to facilitate the current regulation. The use of a relatively large capacitance, along with the additional circuitry needed to effect power correction, has the effect of increasing the overall physical size of the power supply circuit. This in turn makes it difficult or impossible to package the power supply circuit within the form factor of a standard incandescent bulb. Also, pre-existing regulation techniques can produce a voltage stress within semiconductor parts. This voltage stress can in turn produce a thermal stress that shortens the effective lifetime of the semiconductor parts.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
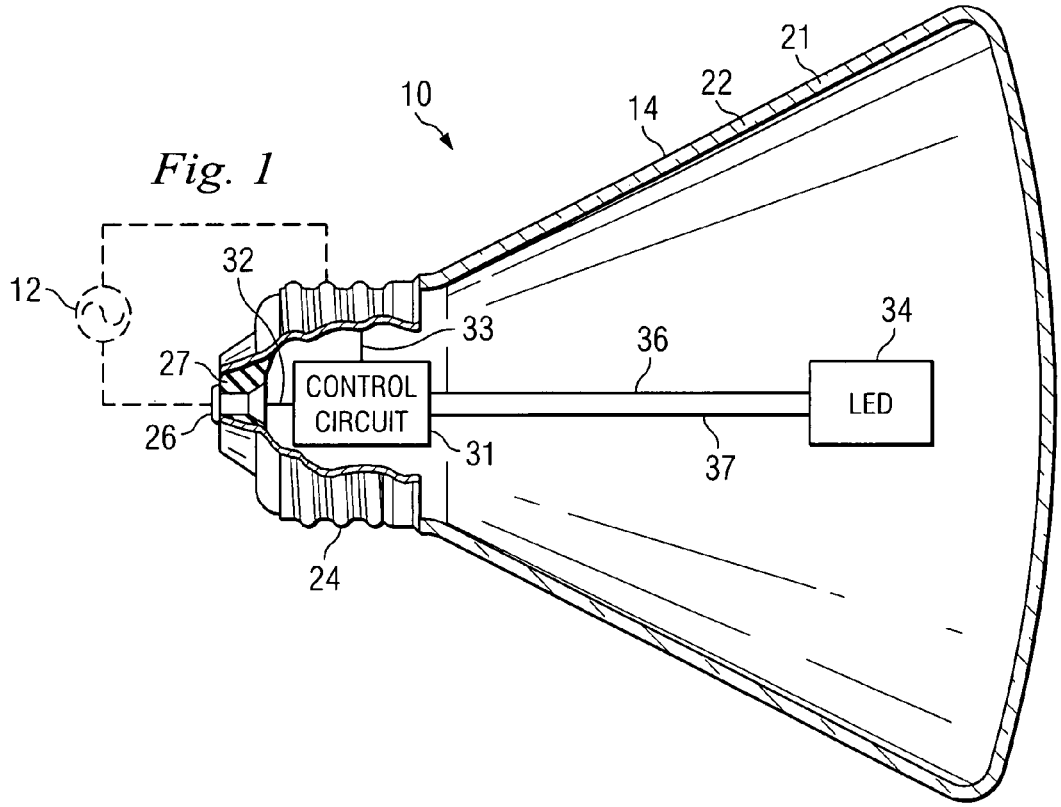
FIG. 1 is a block diagram of a light generating apparatus having a lightbulb that embodies aspects of the invention, and having a conventional power source that is shown diagrammatically in broken lines.

FIG. 1 is a block diagram of a light generating apparatus 10 that has a lightbulb 14 embodying aspects of the invention, and that has a conventional power source 12 shown diagrammatically in broken lines. The power source 12 generates standard household power of 120V at 60 Hz. However, the power source 12 could alternatively generate power at some other voltage and/or frequency.

The lightbulb 14 includes a housing 21, and the housing 21 has a transparent portion 22 and a base 24. The transparent portion 22 is made from a material that is transparent to radiation produced by the lightbulb 14. For example, the transparent portion 22 can be made of glass or plastic. The base 24 is a type of base that conforms to an industry standard known as an E26 or E27 type base, commonly referred to as a medium "Edison" base. Alternatively, however, the base 24 could have any of a variety of other configurations, including but not limited to those known as a candelabra base, a mogul base, or a bayonet base.

The base 24 is made of metal, has exterior threads, and serves as an electrical contact. An annulus 27 is supported on the base 24, and is made from an electrically insulating material. A metal button 26 is supported in the center of the annulus 27. The button 26 is electrically insulated from the base 24 by the annulus 27, and serves as a further electrical contact. The base 24 can be removably screwed into a conventional and not-illustrated socket of a lamp or light fixture, until the contacts 24 and 26 of the lightbulb 14 engage not-illustrated electrical contacts of the socket. In this manner, the contacts 24 and 26 become electrically coupled to opposite sides of the power source 12, as indicated diagrammatically in FIG. 1 by broken lines extending from the power source 12 to the lightbulb 14.

A control circuit 31 is disposed within the base 24, and has two input leads or wires 32 and 33 that respectively electrically couple it to the base 24 and the button 26. Thus, power from the power source 12 is supplied to an input of the control circuit 31. A light-emitting diode (LED) 34 is supported within the lightbulb 14 by not-illustrated support structure. The LED 34 is electrically coupled to an output of the control circuit 31 by two leads or wires 36 and 37. As a practical matter, the lightbulb 14 actually includes a plurality of the LEDs 34 that are all coupled to the output of the control circuit 31. However, for simplicity and clarity, and since FIG. 1 is a block diagram, FIG. 1 shows only one of the LEDs 34.

Figure 2:
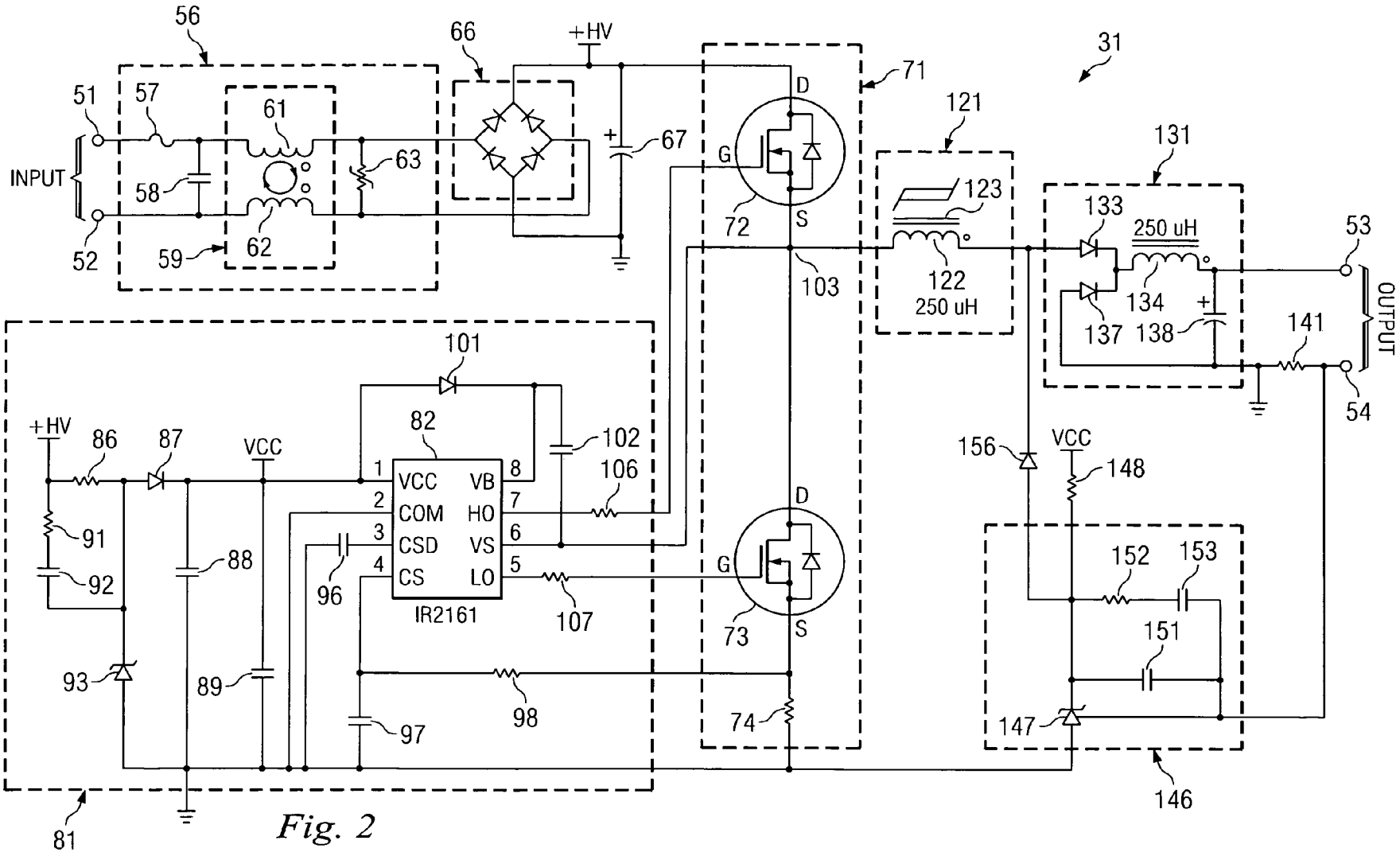
FIG. 2 is a schematic circuit diagram showing a control circuit that is part of the lightbulb of FIG. 1.

FIG. 2 is a schematic circuit diagram showing the actual circuitry within the control circuit 31 of FIG. 1. More specifically, with reference to FIG. 2, the input of the control circuit 31 is defined by two input terminals 51 and 52, and the output is defined by two output terminals 53 and 54. The control circuit 31 has an input section 56, and the input section 56 has a fuse 57 and a capacitor 58 that are coupled in series with each other between the input terminals 51 and 52. A common mode coil 59 includes two coils 61 and 62. The coils 61 and 62 each have one end coupled to a respective end of the capacitor 58, and a further end coupled to a respective end of a metal oxide varistor (MOV) 63.

The control circuit 31 includes a diode bridge 66 that has two input terminals coupled to respective ends of the MOV 63, and that has two output terminals. One output terminal of the diode bridge 66 is coupled to ground, and the other output terminal provides a voltage +HV to other portions of the circuit 31. A capacitor 67 has each of its ends coupled to a respective output terminal of the diode bridge 66.

Figure 3:
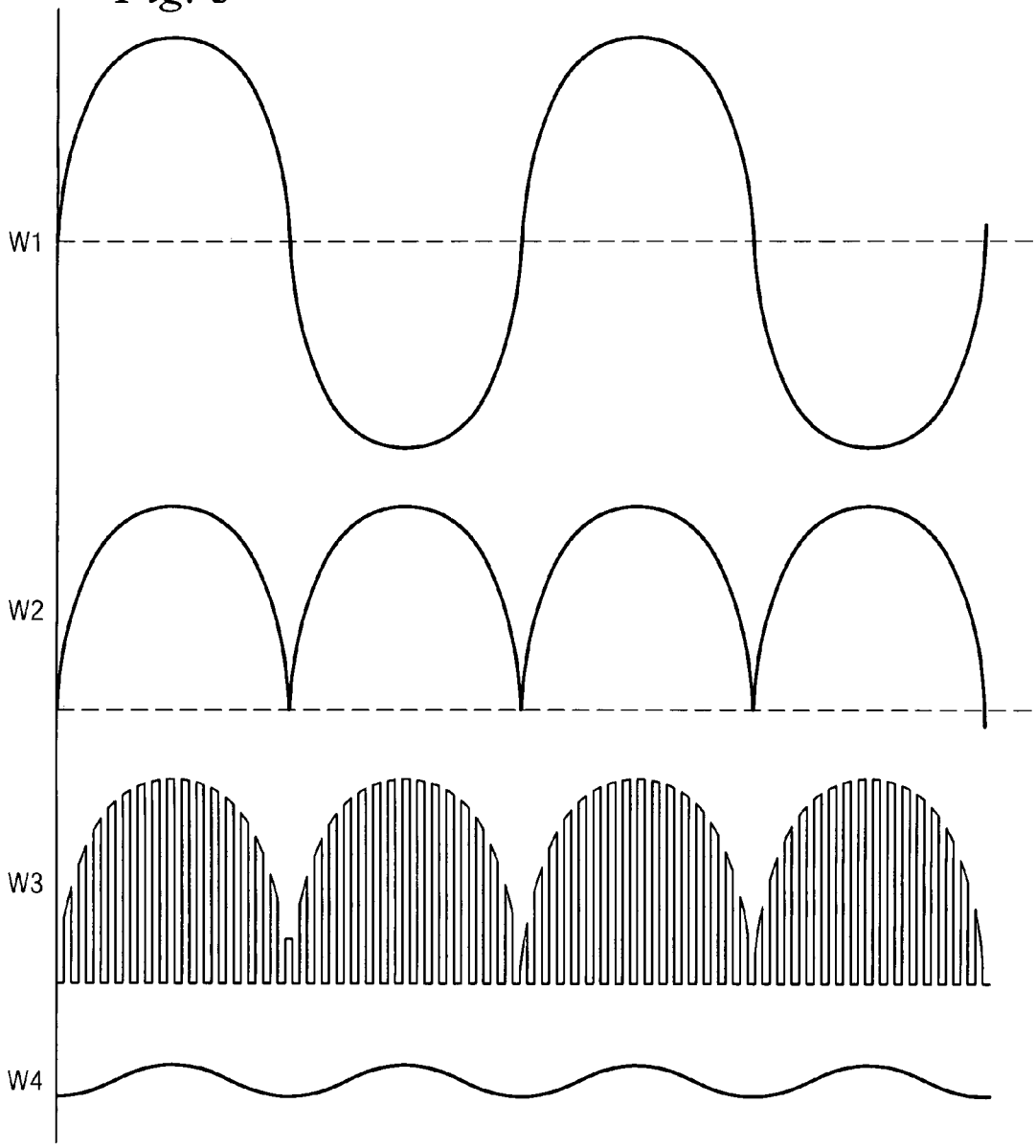
FIG. 3 is a timing diagram that shows several related waveforms within the circuit of FIG. 2.

FIG. 3 is a timing diagram that shows several related waveforms within the circuit 31. In FIG. 3, waveform W1 is an input signal or waveform that is present at the input terminals 51 and 52 of the circuit 31. In the disclosed embodiment, the waveform W1 is the 120V, 60 Hz sine wave produced by the power source 12 (FIG. 1). The input section 56 carries out some filtering and protection, and then the waveform W1 is rectified and further filtered by the diode bridge 66 and the capacitor 67. Waveform W2 in FIG. 3 represents the voltage that is present between the output terminals of the diode bridge 66, or in other words the voltage across the capacitor 67. This is the same as the voltage +HV in FIG. 2.

The circuit 31 includes a chopping section 71 that has two field effect transistors (FETs) 72 and 73, and a resistor 74. The transistors 72 and 73 and the resistor 74 are all coupled in series with each other between the output terminals of the diode bridge 66. The transistor 73 is disposed between the transistor 72 and the resistor 74, with its drain coupled to the source of transistor 72, and its source coupled to one end of the resistor 74. The transistors 72 and 73 serve as electronic switches, as discussed later.

The circuit 31 includes a switching control section 81, and the switching control section 81 includes an integrated circuit device 82. The integrated circuit device 82 is a component that is commercially available as part number IR2161 from International Rectifier Corporation of El Segundo, Calif. The switching control section 81 further includes a resistor 86, a diode 87 and a capacitor 88 that are coupled in series with each between the output terminals of the diode bridge 66. The capacitor 88 has one end coupled to ground, and its other end coupled to the cathode of diode 87. The diode 87 is disposed between the resistor 86 and the capacitor 88. A further capacitor 89 is coupled in parallel with the capacitor 88. A resistor 91 and a capacitor 92 are coupled in series with each other across the resistor 86, the anode of diode 87 being coupled to one end of capacitor 92. A Zener diode 93 has its anode coupled to ground, and has its cathode coupled to the anode of diode 87. An operating voltage VCC for the integrated circuit device 82 is produced at the cathode of diode 87. The cathode of diode 87 is coupled to a VCC pin of the device 82.

The device 82 has a further pin COM that is coupled to ground. Two capacitors 96 and 97 each have one end coupled to ground, and the other end coupled to a respective one of two pins CSD and CS of the device 82. The pin CS is also coupled through a resistor 98 to a circuit node 103 disposed between the transistor 73 and the resistor 74. A diode 101 has its anode coupled to the cathode of diode 87, and its cathode coupled to a pin VB on the device 82. A capacitor 102 has one end coupled to the cathode of diode 102, and its other end coupled to a pin VS of the device 82. The pin VS of device 82 is also coupled to the circuit node 103 between transistors 72 and 73. The device 82 has an output pin HO that is coupled through a resistor 106 to the gate of transistor 72, and has a further output pin LO that is coupled through a resistor 107 to the gate of transistor 73.

Figure 4:
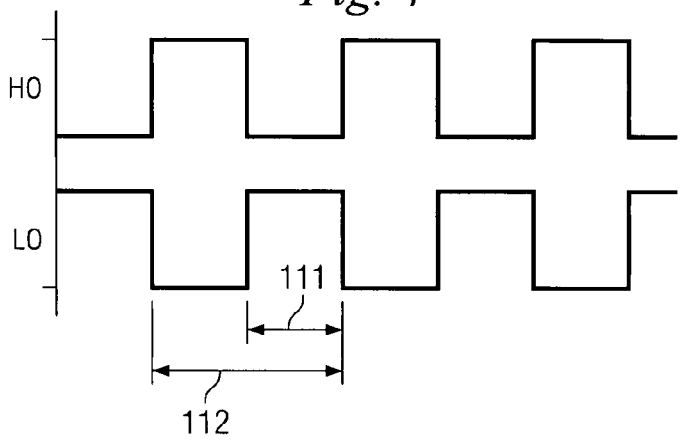
FIG. 4 is a timing diagram showing two additional waveforms within the circuit of FIG. 2.

FIG. 4 is a timing diagram showing the two waveforms that are respectively produced at the output pins HO and LO of the device 82. As evident from FIG. 4, these waveforms are logical inverses of each other, and each is a square-wave signal with a duty cycle of approximately 50%. That is, the width 111 of each pulse is approximately 50% of the period 112 of the signal. In the disclosed embodiment, the signals at output pins HO and LO each have a frequency of approximately 100 KHz. However, these signals could alternatively have some other frequency, so long as it is substantially higher than the frequency of the power source 12 (FIG. 1), or in other words the frequency of the waveform W1 (FIG. 3).

As explained above, the two waveforms shown in FIG. 4 are each applied to the gate of a respective one of the transistors 72 and 73. Consequently, referring again to FIG. 2, the transistors 72 and 73 are alternately actuated with a 50% duty cycle, thereby chopping the rectified waveform W2 (FIG. 3) from the output of-the diode bridge 66. In FIG. 3, waveform W3 is a diagrammatic representation of the chopped signal present at the circuit node 103 (FIG. 2) between transistors 72 and 73. The chopped waveform W3 at circuit node 103, has a frequency of 100 KHz. But for clarity, the waveform W3 is shown diagrammatically in FIG. 3 with a pulse width and a period that correspond to a lower frequency.

Referring again to FIG. 2, the control circuit 31 includes a magnetic amplifier 121 that operates as a form of magnetic switch. The magnetic amplifier 121 includes a coil 122 and a core 123. The core 123 can switch between two different magnetic states, with a degree of hysterisis. In particular, current flowing in one direction through the coil 122 can switch the core 123 to one state, and current flowing in the opposite direction through the coil 122 can switch the core 123 to its other state. When the core 123 is respectively in its two different magnetic states, the coil 122 respectively exhibits a high impedance and a low impedance to current flow. In other words, when the core 123 is in one state, the coil 122 exhibits a high impedance that permits only a small current flow through the coil 122. In contrast, when the core 123 is in its other state, the coil 122 exhibits a low impedance that permits a significantly larger current flow through the coil 122. A sufficient current flow through the coil 122 from left to right in FIG. 2 can switch the core 123 from a magnetic state in which the coil 122 exhibits a high impedance to a magnetic state in which the coil 122 exhibits a low impedance. Similarly, a sufficient current flow through the coil 122 from right to left in FIG. 2 can switch the core 123 from a magnetic state in which the coil 122 exhibits a low impedance to a magnetic state in which the coil 122 exhibits a high impedance.

The circuit 131 includes a smoothing and averaging section 131. The section 131 includes a diode 133 and a storage coil 134, the storage coil 134 having a magnetic core associated therewith. The diode 133 has its anode coupled to an output side of the magnetic amplifier 121, and the coil 134 is coupled between the cathode of diode 133 and the output terminal 53. The section 131 also includes a further diode 137 and a capacitor 138. The diode 137 has its cathode coupled to the cathode of diode 133, and its anode coupled to ground. The capacitor 138 has one end coupled to the output terminal 53, and its other end coupled to ground. A resistor 141 has one end coupled to the output terminal 54, and its other end coupled to ground.

The control circuit 31 includes an integrating section 146, which in turn includes a shunt regulator 147. The anode of the shunt regulator 147 is coupled to ground, and the cathode is coupled through a resistor 148 to the supply voltage VCC. A control terminal of the shunt regulator 147 is coupled to the output terminal 54. The integrating section 146 also includes a capacitor 151, a resistor 152, and a capacitor 153. The capacitor 151 has one end coupled to the cathode of shunt regulator 147, and its other end coupled to the output terminal 54. The resistor 152 and the capacitor 153 are coupled in series with each other between the cathode of shunt regulator 147 and the output terminal 54, with one end of resistor 152 coupled to the cathode of the shunt regulator 147. A diode 156 has its anode coupled to the cathode of shunt regulator 147, and its cathode coupled to the anode of diode 133, and thus to the output side of the magnetic amplifier 121.

Figure 5:
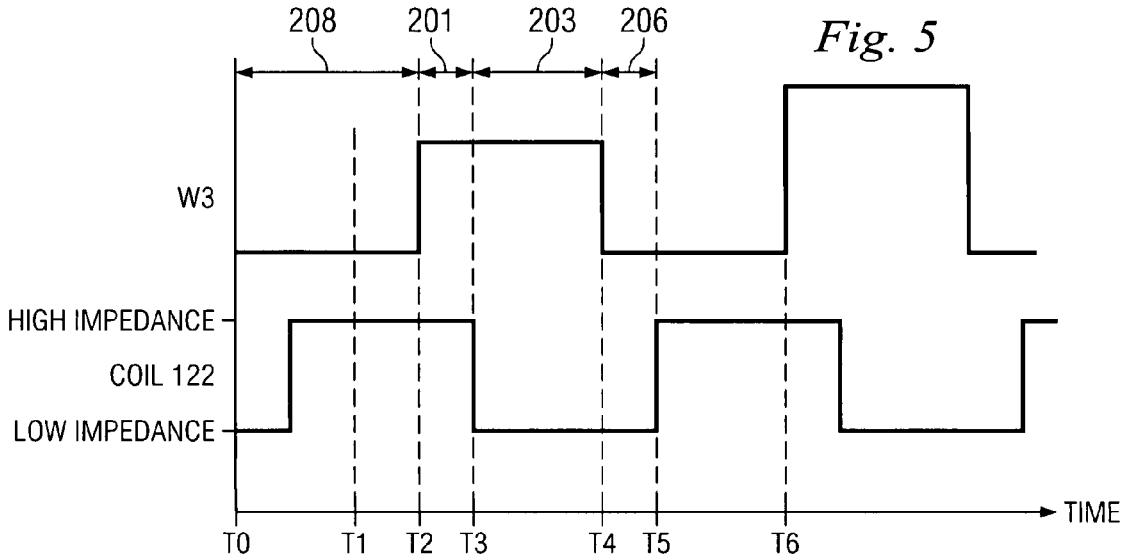
FIG. 5 is a timing diagram that shows, in a time-expanded scale, two pulses from one of the waveforms in FIG. 3, and that includes a diagrammatic representation of when a coil in the circuit of FIG. 2 is respectively in high and low impedance states.

As discussed earlier, the waveform at circuit node 103 between transistors 72 and 73 is the chopped waveform shown at W3 in FIG. 3. FIG. 5 is a timing diagram that shows two of the pulses of the waveform W3, in a time-expanded scale. Below the waveform W3 in FIG. 5 is a diagrammatic representation of when the coil 122 is respectively in its in its high impedance and low impedance states. As discussed earlier, the coil 122 is respectively in its high and low impedance state when the core 123 is respectively in two different magnetic states.

For the sake of convenience, the discussion that follows will begin at a point in time T1 (FIG. 5), which is between two of the pulses in waveform W3. At time T1, the coil 122 is in its high impedance state. Thereafter, a leading edge of a pulse of the waveform W3 occurs at a time T2. However, since the coil 122 is in its high impedance state, it will initially restrict the amount of current that can flow from the circuit node 103 through the coil 122 to the diode 133. During the time interval 201, energy from the first part of the pulse will counteract energy that is stored in a magnetic field around the coil 122, causing the magnetic field to decrease until it is gone, and then causing an increase in a magnetic field of opposite polarity. In due course, the hysterisis of the core 123 will be overcome, and the core 123 will change magnetic state at time T3, which has the effect of switching the coil 122 from its high impedance state to its low impedance state.

Then, for the remainder of the pulse, or in other words during time interval 203, a larger amount of current can readily flow from the circuit node 103 through the coil 122, the diode 133 and the coil 134 to the output terminals 53 and 54. In other words, during the time interval 203, energy from the pulse is supplied to and flows through the LED 34 (FIG. 1) that is coupled to the output terminals 53 and 54. When the pulse ends at time T4, the current flow induced by the pulse comes to an end. In particular, at time T4, the pulse ends because the transistor 72 is turned off, and the transistor 73 is turned on.

A small reset current flow then commences from the integrating section 146 through the diode 156, the coil 122, the transistor 73, and the resistor 74. This reset current flow progressively removes the energy that, during time interval 203, was stored in a magnetic field around the coil 122. In particular, during time interval 206, this magnetic field is decreased until it is gone, and then a magnetic field of opposite polarity is created and progressively increases. In due course, the hysterisis of the core 123 will be overcome, and the core 123 will change magnetic state at time T5, which has the effect of switching the coil 122 from its low impedance state to its high impedance state.

During time interval 203, as discussed above, energy from a pulse of the waveform W3 is supplied to the outputs 53 and 54 of circuit 31, and thus to the LED 34. By increasing or decreasing the length of time interval 203, it is possible to vary the cumulative amount of current or energy from the pulse that is supplied to the LED 34. In order to effect such an increase or decrease of the time interval 203, the time interval 201 is varied. In particular, the pulse has a fixed length, so as the time interval 201 is increased, the time interval 203 is necessarily decreased, and as the time interval 201 is decreased, the time interval 203 is necessarily increased.

As discussed above, the time interval 201 represents the amount of time that is required to extract energy from and eliminate a magnetic field around the coil 122, and then replace it with another magnetic field of opposite polarity, until the new magnetic field is sufficiently strong to overcome the hysterisis of the core 123 so that core 123 changes magnetic state at the time T3. The length of the time interval 201 is thus based in part of the amount of energy that must be removed from the pre-existing magnetic field around the coil 122. The amount of energy in this pre-existing magnetic field is a function of the amount of energy or current that the integrating section 146 supplied to the coil 122 during the time interval 208 between a trailing edge of a preceding pulse at time T0, and the leading edge of the illustrated pulse at time T2.

The current at the output terminals 53 and 54, or in other words the current flowing through the LED 34, also flows through the resistor 141. As the magnitude of this current increases and decreases, the voltage across resistor 141 respectively increases and decreases, which in turn increases and decreases the voltage between the anode and control terminal of the shunt regulator 147, thereby influencing the integration performed by the integrating section 146. That is, the integration carried out by the integrating section 146 is a function of the amount of current that flows through the LED 34. As the amount of current flowing through LED 34 increases, the voltage across resistor 141 increases, and the integration performed by the integrating section 146 will be affected so as to increase the current flowing through the coil 122 during the time interval 208 between pulses of the waveform W3, which in turn increases the amount of energy stored in the magnetic field around the coil 132. As the amount of energy in this magnetic field increases, the amount of time required to later remove that energy also increases, thereby resulting in an increase in the time interval 201, and a corresponding decrease in the time interval 203. The decrease in time interval 203 causes a decrease in the overall amount current that is supplied to the LED 34 from the next pulse of waveform W3.

Conversely, if the current flowing through the LED 34 decreases, the voltage across resistor 141 decreases, the integrating section 146 decreases the amount of reset current flowing through the coil 122 during the time interval 208 between pulses, thereby reducing the amount of energy stored in the magnetic field around coil 122. As the amount of energy stored in this magnetic field decreases, the amount of time required to later remove the energy decreases, thereby decreasing the time interval 201. The decrease in time interval 201 inherently increases the time interval 203, so that more overall energy or current is supplied to LED 34 from the next pulse of waveform W3. In this manner, the current flowing through the LED 34 is regulated so as to keep it relatively uniform over time. Waveform W4 in FIG. 3 represents the voltage at output terminal 53.

With reference to waveform W3 in FIG. 3, it will be noted that the amplitude of the pulses of this waveform progressively increase and decrease over time. It will be recognized that pulses with smaller magnitudes contain less overall energy than pulses with larger magnitudes. Consequently, if the time interval 203 had the same duration for two pulses of different magnitude, the amount of energy supplied to the LED 34 would be greater for the larger pulse than for the smaller pulse. However, since the circuit 31 monitors the amount of current actually flowing through the LED 34, and varies the length of time interval 203 so as to maintain the current through LED 34 at a uniform level, the circuit 31 automatically compensates for the varying magnitude of the pulses as it regulates the current flow through LED 34.

Due in part to the use of a magnetic amplifier, the disclosed circuit achieves current regulation for an LED without the need for a large capacitor, and without modulating the 120V input signal. Consequently, the circuit does not cause a phase difference between the voltage and current, which in turn means the circuit does not need to make a power correction. Further, in the absence of a large components, and components to effect a power correction, the disclosed power supply circuit is relatively simple, and also relatively compact in overall physical size. The circuit is therefore relatively inexpensive, and can also be packaged within the form factor of a standard incandescent bulb. In particular, as mentioned earlier, the power supply circuit can be placed entirely or almost entirely within a standard Edison lightbulb base. Moreover, the voltage obtained at the node between the two switching transistors is about half of what it otherwise would be, thereby avoiding a voltage stress within semiconductor parts, which in turn avoids thermal stress that can shorten the effective lifetime of semiconductor parts.

Although a selected embodiment has been illustrated and described in detail, it should be understood that a variety of substitutions and alterations are possible without departing from the spirit and scope of the present invention, as defined by the claims that follow.

What is claimed is:

1. An apparatus comprising circuitry having an input and an output, said circuitry responding to application to said input of an alternating current input signal by producing at said output an output signal driving an electronic light generating element, said circuitry including a regulating section that includes a magnetic switch, wherein said regulating section regulates a current flowing through said output such that said regulated current is varied based on changes in a magnetic state of said magnetic switch in response to a pulse train being applied to said magnetic switch.

2. An apparatus according to claim 1, wherein said magnetic switch includes a coil, and includes a magnetizable core having first and second states that are magnetically different, said coil having a first end, having a second end coupled to said output, and respectively having first and second impedances when said core is respectively in said first and second states, said first impedance being substantially higher than said second impedance; and wherein said circuitry includes a pulse generating section that applies a pulse train to said first end of said coil, each pulse of the pulse train forcing said core to said second state so that said coil has said second impedance and energy from the pulse can pass through said coil, said regulating section forcing said core to said first state during each time interval between successive pulses of the pulse train.

3. An apparatus according to claim 2, wherein said circuitry includes a smoothing section that is coupled between said second end of said coil and said output of said circuitry.

4. An apparatus according to claim 2, wherein said circuitry includes first and second nodes, and applies between said first and second nodes an alternating current derived signal that is derived from said input signal; and wherein said pulse generating section includes first and second electronic switches that are coupled in series with each other between said first and second nodes, and that are alternately actuated at a frequency substantially greater than a frequency of said derived signal in order to generate the pulse train at a third node disposed between said electronic switches, said first end of said coil being coupled to said third node.

5. An apparatus according to claim 4, wherein said circuitry includes a rectification section that rectifies said input signal to produce a rectified signal, said derived signal being based on said rectified signal.

6. An apparatus according to claim 4, wherein each of said electronic switches is actuated and deactuated with a duty cycle of approximately 50%.

7. An apparatus according to claim 2, wherein said regulating section includes an integrating section that is responsive to the current flowing through said output of said circuitry and that has an output coupled to said second end of said coil.

8. An apparatus according to claim 7, including a diode coupled between said output of said integrating section and said second end of said coil.

9. An apparatus according to claim 7, wherein said pulse generating section includes first and second electronic switches that are coupled in series with each other between first and second nodes of said circuitry, and that are alternately actuated, said first end of said coil being coupled to a third node disposed between said electronic switches.

10. An apparatus according to claim 1, including an electronic light generator coupled to said output of said circuitry.

11. An apparatus according to claim 10, including a lightbulb housing having a transparent portion and an electrical connector portion, said electronic light generator being disposed within said housing, and said circuitry being disposed within said housing with said input thereof coupled to said connector portion and said output thereof coupled to said electronic light generator, light from said electronic light generator passing through said transparent portion of said housing.

12. A method of operating circuitry having an input, an output and a magnetic switch, comprising;

responding to application to said input of an alternating current input signal by producing at said output an output signal driving an electronic light generating element, including regulating a current flowing through said output in a manner that includes use of said magnetic switch, by varying said regulated current based on changes in a magnetic state of said magnetic switch in response to a pulse train being applied to said magnetic switch.

13. A method according to claim 12, including:

configuring said magnetic switch to include a coil having a first end, and having a second end coupled to said output, and to include a magnetizable core having first and second states that are magnetically different, said coil respectively having first and second impedances when said core is respectively in said first and second states, said first impedance being substantially higher than said second impedance;

applying a pulse train to said first end of said coil, each pulse of the pulse train forcing said core to said second state so that said coil has said second impedance and energy from the pulse can pass through said coil; and forcing said core to said first state during each time interval between successive pulses of the pulse train.

14. A method according to claim 13, wherein said producing of said output signal includes smoothing a signal from said second end of said coil.

15. A method according to claim 13, including:

deriving from said input signal an alternating current derived signal; and generating said pulse train in a manner that includes chopping said derived signal at a frequency substantially greater than a frequency of said input signal.

16. A method according to claim 15, wherein said deriving includes rectifying said input signal.

17. A method according to claim 13, including:

integrating a current flowing through said output of said circuitry; and applying to said second end of said coil a signal that is a function of the integration.

18. A method according to claim 12, including applying said output signal of said circuitry to an electronic light generator.

19. The apparatus according to claim 1, wherein:

said electronic light generating element comprises a light emitting diode;

said magnetic switch includes a coil, and a core switchable between first and second states that are magnetically different, said coil having first and second impedances when said core is in said first and second states respectively, said first impedance being higher than said second impedance, and wherein said regulating section varies said regulated current based on said first and second impedances of said coil.

20. The method according to claim 12, wherein said electronic light generating element comprises a light emitting diode; and further comprising:

configuring said magnetic switch to include a coil, and a core switchable between first and second states that are magnetically different, said coil having first and second impedances when said core is in said first and second states respectively, said first impedance being higher than said second impedance; and varying said regulated current based on said first and second impedances of said coil.

* * * * *